US012616870B2

(12) United States Patent
Vicars et al.

(10) Patent No.: US 12,616,870 B2
(45) Date of Patent: May 5, 2026

(54) METHOD OF PERFORMING A PLANK STYLE EXERCISE AND DEVICE FOR USE THEREWITH

(71) Applicant: Plankcore Assist LLC, Alliance, OH (US)

(72) Inventors: Craig S Vicars, Alliance, OH (US); Aireen S Vicars, Alliance, OH (US)

(73) Assignee: Plankcore Assist LLC, Alliance, OH (US)

( * ) Notice: Subject to any disclaimer, the term of this patent is extended or adjusted under 35 U.S.C. 154(b) by 128 days.

(21) Appl. No.: 18/767,472

(22) Filed: Jul. 9, 2024

(65) Prior Publication Data

US 2025/0018241 A1 Jan. 16, 2025

Related U.S. Application Data

(60) Provisional application No. 63/513,631, filed on Jul. 14, 2023.

(51) Int. Cl.

| | |
|---|---|
| ***A63B 21/00*** | (2006.01) |
| ***A63B 21/002*** | (2006.01) |
| ***A63B 21/16*** | (2006.01) |
| ***A63B 23/02*** | (2006.01) |

(52) U.S. Cl.

CPC ..... *A63B 21/4034* (2015.10); *A63B 21/002* (2013.01); *A63B 21/169* (2015.10); *A63B 21/4049* (2015.10); *A63B 23/0216* (2013.01); *A63B 2208/0295* (2013.01); *A63B 2225/09* (2013.01)

(58) Field of Classification Search

CPC ..... A63B 21/00047; A63B 21/002; A63B 21/068; A63B 21/169; A63B 21/4015; A63B 21/4034; A63B 21/4049; A63B 23/0205; A63B 23/0216; A63B 23/0233; A63B 26/00; A63B 26/003; A63B 69/0062; A63B 2208/0295; A63B 2210/50; A63B 2225/09; A63B 2225/093

See application file for complete search history.

(56) References Cited

U.S. PATENT DOCUMENTS

| | | | | |
|---|---|---|---|---|
| 2,351,293 A | | 6/1944 | Saunders | |
| 3,767,191 A | * | 10/1973 | Riley | A63B 22/20 482/25 |
| 3,895,795 A | * | 7/1975 | Merz | A63B 21/0618 482/141 |

(Continued)

FOREIGN PATENT DOCUMENTS

| | | |
|---|---|---|
| WO | 2004035144 | 4/2004 |
| WO | 2012177918 | 12/2012 |
| WO | 2017189625 | 11/2017 |

*Primary Examiner* — Gary D Urbiel Goldner

(74) *Attorney, Agent, or Firm* — Sand, Sebolt & Wernow Co., LPA

(57) ABSTRACT

A plank training device having a base with a first length and a foot support assembly rotatably engaged with the base. The foot support assembly defines a foot well and is rotatable about an axis relative to the base. The foot well is adapted to receive at least a portion of a human's feet. The foot support assembly has a base plate adapted to support the portion of the human's feet. The plank training device also includes at least one riser removably connected to a bottom of the base which allows the plank training device to have a greater length.

20 Claims, 13 Drawing Sheets

(56) References Cited

U.S. PATENT DOCUMENTS

| | | | | |
|---|---|---|---|---|
| 7,753,829 | B1 * | 7/2010 | Schaller | A63B 21/4015 482/145 |
| 8,226,533 | B2 * | 7/2012 | Wessels | A63B 26/00 482/141 |
| 10,279,213 | B2 | 5/2019 | Agostini | |
| 10,596,411 | B2 * | 3/2020 | Callanan | A63B 22/20 |
| 11,097,153 | B1 | 8/2021 | Lee | |
| 11,110,319 | B1 * | 9/2021 | Boyd | A63B 21/4033 |
| 11,123,591 | B2 | 9/2021 | Thomas | |
| 11,344,767 | B1 * | 5/2022 | Lagioia | A63B 21/4049 |
| 11,752,388 | B2 * | 9/2023 | Lagioia | A63B 23/03525 482/91 |
| 11,844,979 | B2 * | 12/2023 | Barbera | A63B 21/4035 |
| 12,076,610 | B2 * | 9/2024 | Bosch | A63B 21/4049 |
| 12,115,410 | B2 * | 10/2024 | Lagioia | A63B 21/068 |
| 12,268,924 | B2 * | 4/2025 | Barbera | A63B 21/4049 |
| 2003/0125173 | A1 * | 7/2003 | Fan | A63B 22/18 482/146 |
| 2003/0181300 | A1 | 9/2003 | Chin | |
| 2007/0298947 | A1 | 12/2007 | Eksteen | |
| 2013/0184131 | A1 * | 7/2013 | Doyle | A63B 26/003 482/139 |
| 2016/0220862 | A1 | 8/2016 | Johnson | |
| 2016/0263424 | A1 * | 9/2016 | LaCaze | A63B 21/068 |
| 2017/0014666 | A1 * | 1/2017 | Sather | A63B 21/4045 |
| 2017/0304675 | A1 * | 10/2017 | Panes | A63B 23/0216 |
| 2020/0282259 | A1 * | 9/2020 | Olmstead | A63B 43/02 |
| 2021/0260438 | A1 * | 8/2021 | Bosch | A63B 21/154 |
| 2022/0257998 | A1 | 8/2022 | Lagioia | |
| 2023/0271054 | A1 * | 8/2023 | Barbera | A63B 21/4045 482/142 |

* cited by examiner

METHOD OF PERFORMING A PLANK STYLE EXERCISE AND DEVICE FOR USE THEREWITH

REFERENCE TO RELATED APPLICATIONS

This application claims the benefit of U.S. Provisional Application Ser. No. 63/513,631, filed on Jul. 14, 2023; the disclosure of which is incorporated herein by reference.

TECHNICAL FIELD

The present disclosure related generally to exercise and exercise equipment. More particularly, in one example, the present disclosure relates to the method and apparatus for performing plank and other similar exercises. Specifically, in another example, the present disclosure relates to an exercise device to allow a user to perform planks and other similar style exercises while varying the angles and resistance for increased performance and versatility thereof.

BACKGROUND ART

Planking as an exercise is considered a core exercise in that it is a method of exercising the muscles that make us the core of a person's body. Specifically, planking targets the abdomen, sides, and related muscles stretching across the chest and abdomen ranging between the hips and the shoulders. Planking, as is currently accepted, is performed by a user assuming a pushup-like position often with the user's forearms against the floor and their feet stretched out behind them. The core muscles are engaged to maintain a straight posture while supporting one's self above the floor or ground surface using only their feet and forearms.

Variations on planking as an exercise include raising the feet above the ground level by placing them on a raised surface such as a box or bench. Other variations include rotating the torso and/or upper body to raise one arm off the floor to create unbalance further engaging core muscles to keep the body in proper position and alignment.

Other variations on planking can include assuming a pushup-like position and moving the arms and/or legs to cause muscular stress emphasizing different target areas to force the core muscles to adapt to support the user's body.

Current versions and variations of planking are difficult and often require significant practice and experience to master these movements. Further compounding this difficulty is the increased likelihood of injury as one advances into newer variations on planking, specifically referring to those variations that require the user to move their feet and/or legs to a new position while balancing on their hands or forearms. This may cause a user to lose their balance and may result in fall injuries, muscle strains, or the like.

SUMMARY OF THE INVENTION

A plank training device having a base with a first length and a foot support assembly rotatably engaged with the base. The foot support assembly defines a foot well and is rotatable about an axis relative to the base. The foot well is adapted to receive at least a portion of a human's feet. The foot support assembly has a base plate adapted to support the portion of the human's feet. The plank training device also includes at least one riser removably connected to a bottom of the base which allows the plank training device to have a greater length.

In one aspect, an exemplary embodiment of the present disclosure may provide a plank training device, comprising a base having a first length, a foot support assembly rotatably engaged with the base, a foot well defined by the foot support assembly, wherein the foot well is adapted to receive at least a portion of a human's feet, and where the foot support assembly is rotatable about an axis relative to the base.

In another aspect, an exemplary embodiment of the present disclosure may provide further comprising a base plate of the foot support assembly adapted to support the portion of the human's feet, at least one adjustable block adjustable relative to the base plate of the foot support assembly, and where the adjustment of the at least one adjustable block defines a size of the foot well. In another aspect, an exemplary embodiment of the present disclosure may provide further comprising at least one riser removably connected to a bottom of the base in which the at least one riser and the base are collectively defined at a second length that is greater than the first length. In another aspect, an exemplary embodiment of the present disclosure may provide further comprising a first riser removably connected to a bottom of the base in which the first riser and the base are collectively defined at a second length that is greater than the first length, and a second riser removably connected to a bottom of the first riser in which the first riser, the second riser and the base are collectively defined at a third length that is greater than the first and second lengths. In another aspect, an exemplary embodiment of the present disclosure may provide where the at least one adjustment block further comprises an adjustment screw releasably engaging the at least one adjustment block to the foot support assembly between one or more position relative to the foot support assembly. In another aspect, an exemplary embodiment of the present disclosure may provide further comprise a first set of adjustment apertures defined in the at least one adjustment block to receive an adjustment screw, and where the at least one adjustment block is moveable between a first position when the adjustment screw is secured to the foot support assembly through a first adjustment aperture of the first set of adjustment apertures and a second position when the adjustment screw is secured to the foot support assembly through a second adjustment aperture of the first set of adjustment apertures. In another aspect, an exemplary embodiment of the present disclosure may provide further comprising a base plate of the foot support assembly adapted to support the portion of the human's feet, a first adjustable block adjustable relative to the base plate of the foot support assembly, a second adjustable block adjustable relative to the base plate of the foot support assembly, and where the adjustment of the first and second adjustable block defines a size of the foot well. In one aspect, an exemplary embodiment of the present disclosure may provide where the at least one adjustment block is moveable relative to the base plate via the at least one adjustment aperture and is secured thereto by the at least one adjustment screw. In one aspect, an exemplary embodiment of the present disclosure may provide where the base further comprises a back plate adapted to engage a wall surface, a bottom plate adapted to engage a floor surface, and where the back plate and the bottom plate engaged with and substantially perpendicular to one another. In one aspect, an exemplary embodiment of the present disclosure may provide further comprising at least one hole defined in the back plate, wherein the at least one hole is adapted to receive a screw that secures the base to the wall surface at the at least one hole. In one aspect, an exemplary embodiment of the present disclosure may provide where the foot support assembly further comprises at least one slot extending through the base plate of the foot assembly, at least one locking device extending through the at least one adjustment block and the at least one slot, and where the at least one locking device is configured to releasably secure the at least one adjustment block in a desired position relative to the base plate. In one aspect, an exemplary embodiment of the present disclosure may provide where the first adjustment block slidably engages the base plate of the foot assembly via the first and second slots. In one aspect, an exemplary embodiment of the present disclosure may provide where the first adjustment block slidably engages the first and second slots together or individually. In one aspect, an exemplary embodiment of the present disclosure may provide further comprising at least one base block engaged with the at least one adjustment block, and at least one screw receiver defined by the at least one base block. In one aspect, an exemplary embodiment of the present disclosure may provide further comprising at least one block slide rail located on the at least one base block, where the at least one adjustment block is mounted on the at least one block base, and where the at least one adjustment block secured to the at least one block base via an at least one adjustment screw. In one aspect, an exemplary embodiment of the present disclosure may provide where the at least one adjustment block is housed inside a cavity.

In one aspect, an exemplary embodiment of the present disclosure may provide a method of performing planking exercises comprising placing a base of a plank training device on a ground surface adjacent a wall at a first length, inserting at least one of a user's feet into a foot well defined in a foot support assembly of the plank training device, and rotating the foot support assembly in a relative to the base of the plank training device while maintaining a plank position.

In another aspect, an exemplary embodiment of the present disclosure may provide the method further comprising adjusting at least one adjustment block of the foot support assembly to change a size of the foot well from a first width to a second width that is less than the first width. In another aspect, an exemplary embodiment of the present disclosure may provide the method further comprising adjusting a first adjustment block of the foot support assembly from a first position to a second position, adjusting a second adjustment block of the foot support assembly from a third position to a fourth position, and defining the second width when the first adjustment block and the second adjustment block are adjusted to the second position and the fourth position. In another aspect, an exemplary embodiment of the present disclosure may provide the method further comprising connecting at least one riser to the base, and defining a second length by the at least one rise and the base, collectively.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
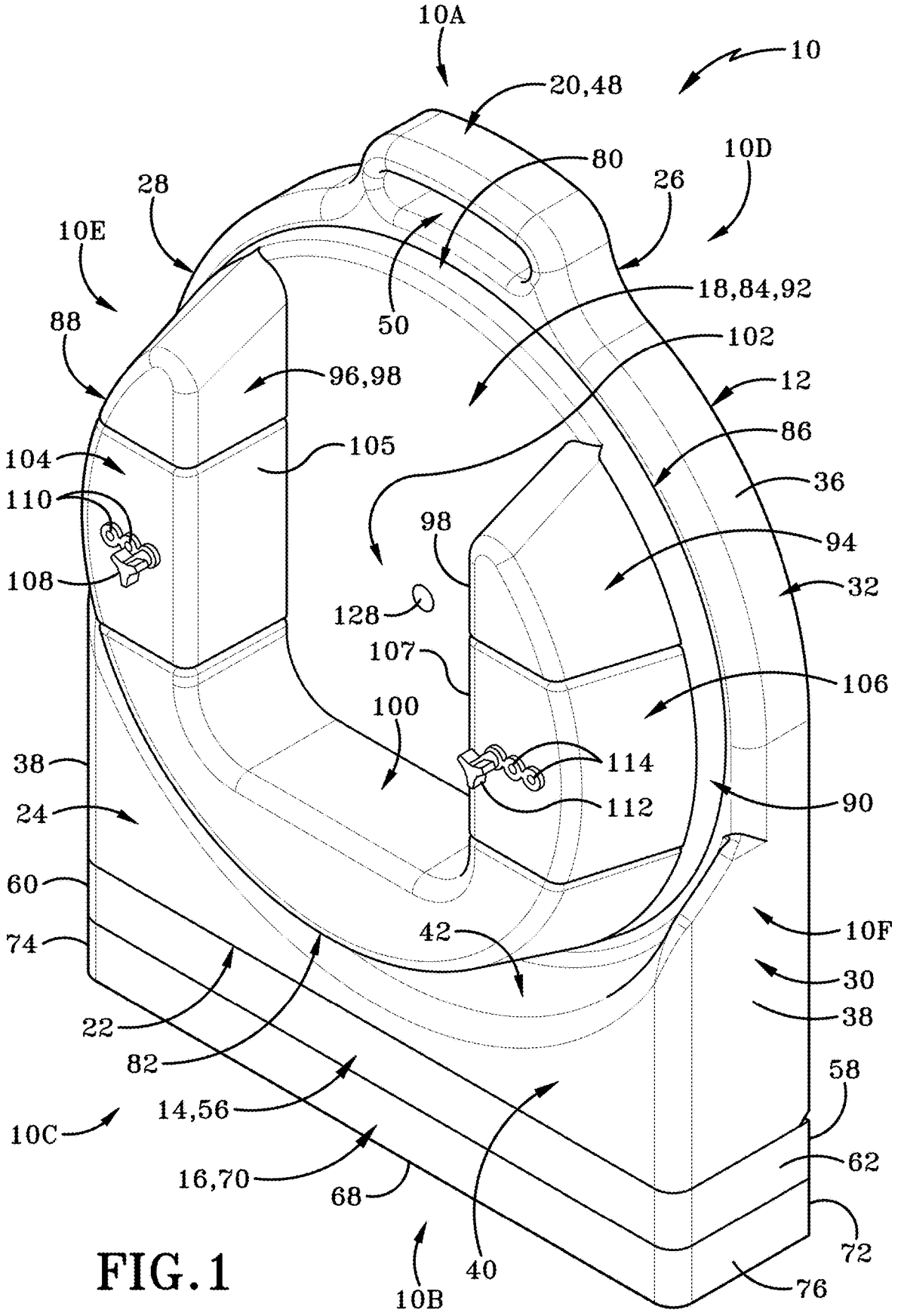
FIG. 1 is a front, right, top perspective view of a first embodiment of a plank training device according with the present disclosure.
Figure 2:
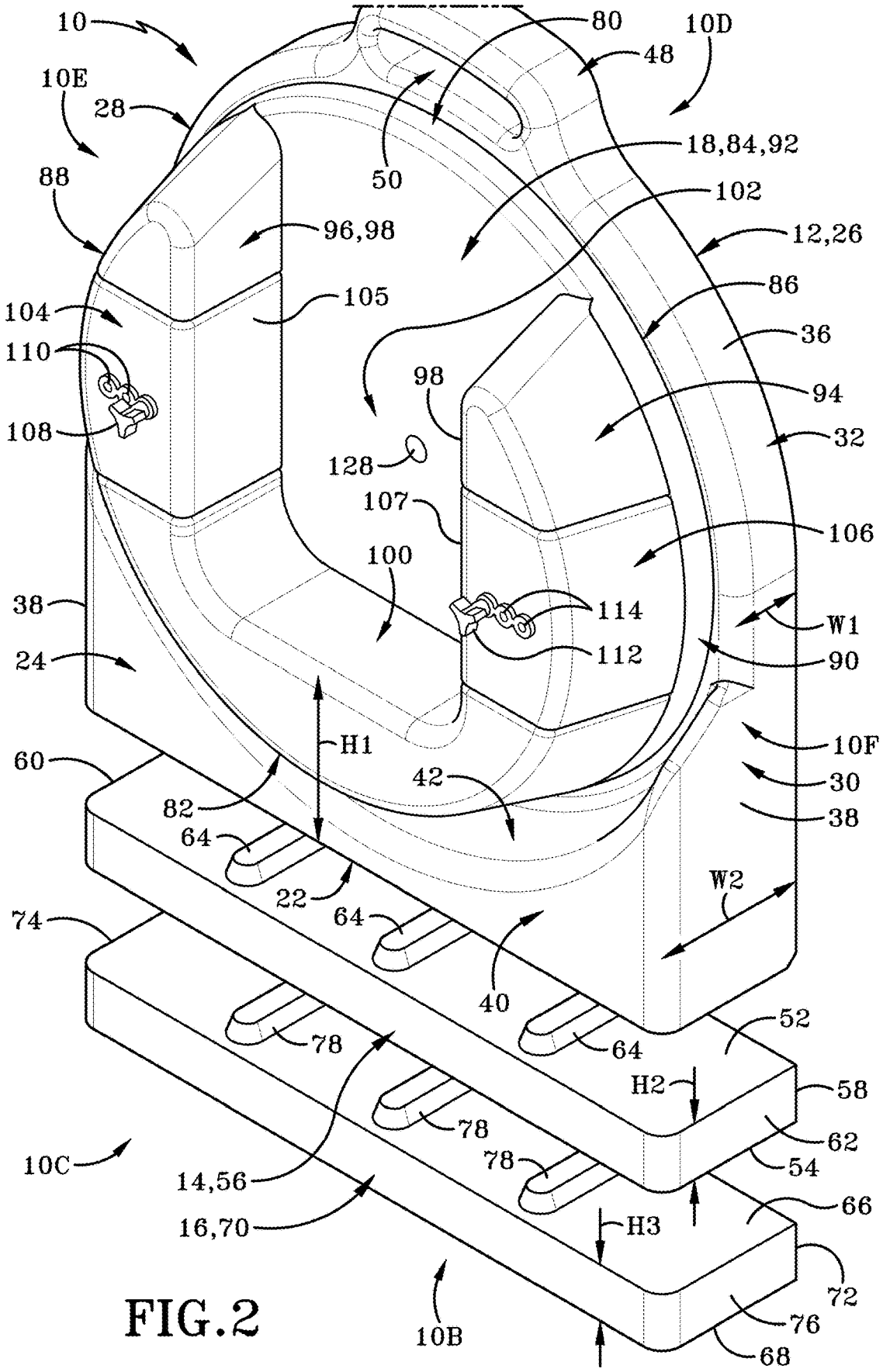
FIG. 2 is a front, right, top perspective exploded view of a portion of the first embodiment of the plank training device shown FIG. 1.
Figure 3:
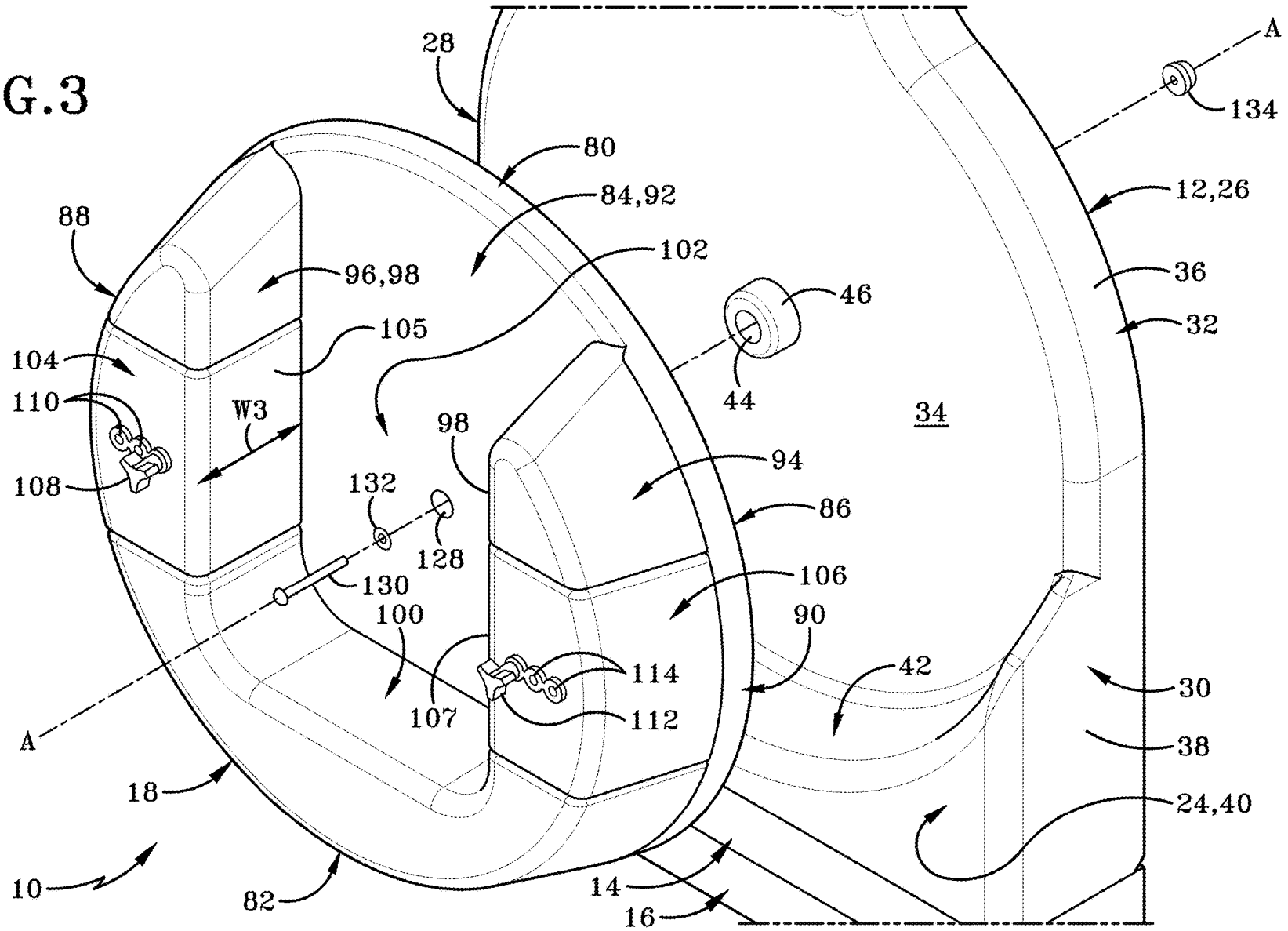
FIG. 3 is a front, right, top perspective exploded view of another portion of the first embodiment of the plank training device shown in FIG. 1.

With reference to FIGS. 1-3, a planking training device, referred to further herein as plank trainer, is shown and generally indicated at reference 10. Plank trainer 10 may generally include four main components. Namely, a base 12, a first riser block or riser 14, a second riser block or riser 16, and a foot support rotation assembly 18, referred to herein as foot support assembly 18.

Base 12, risers 14 and 16, and foot support assembly 18 may be formed of any suitable material utilizing any suitable method of manufacture. According to one aspect, plank trainer 10 and the components thereof may be formed of metal, polymer plastic, resin, or similar material and may be manufactured utilizing molding, casting, and/or additive manufacturing as dictated by the desired implementation. According to another aspect, the elements and components may be formed of any suitable material including combinations of material as desired. According to another aspect, one version of plank trainer 10 and the components thereof may be formed of a sturdier material, such as metal, and may be installed in a permanent or semi-permanent manner for more frequent use, such as in a commercial or shared gym while another version may be formed of lighter weight material, such as plastic, for home/personal use and/or for travel.

Generally speaking, plank trainer 10 may have a top 10A spaced vertically apart from a bottom 10B, a front 10C spaced transversely apart from a back 10D and defining the thickness of plank trainer 10 there between, and a first side 10E spaced longitudinally apart from a second side 10F and defining the overall width of the plank trainer 10 there between.

Although plank trainer 10 may be formed of suitable material it is contemplated and will be further understood that plank trainer 10 may be formed of any suitable material capable of supporting the weight of a user as planking exercises are performed, as discussed further herein.

With continued reference to FIGS. 1-3 but particular reference to FIGS. 1 and 2, base 12 may include a top 20 spaced vertically apart from a bottom 22 and defining the height H1 of base 12, a front 24 spaced transversely apart from a back 26 and defining the thickness of base 12 there between, and a first side 28 spaced longitudinally apart from a second side 30 and defining the overall width of the base 12 there between. The top 20, bottom 22, front 24, back 26, first side 28, and second side 30 may generally correspond to top 10A, bottom 10B, front 10C, back 10D, first side 10E, and second side 10F of plank trainer 10.

Base 12 may generally have an outer wall 32, which may extend around the exterior of base 12 and may further define the overall shape of base 12. Base 12 may further include a flat surface 34 (best seen in FIG. 3), which may serve as the interaction point between base 12 and foot support assembly 18 as discussed further herein.

Outer wall 32 of base 12 may further define a pair or curved shoulders 36 towards the top 20 of base 12 with opposing vertical sides 38 on each of first and second sides 28 and 30 of base 12. Vertical sides 38 may extend vertically upwards from bottom 22 and may transition into curved shoulders 36 before terminating at top 20. Base 12 may further include a platform 40 on the front side 24 thereof towards the bottom 22 of base 12, which may further define a curved inner wall 42, which may correspond to the bottom 82 of foot support assembly 18 as described further herein. The platform 40 and curved inner wall 42 may additionally provide stability to plank trainer 10, as they may be substantially thicker in width than the upper portions towards the top 20 of base 12. Specifically, the upper portions of base 12, including curved shoulders 36, may have a first width W1, which may be substantially narrower than a second width W2 of platform 40, as seen in FIG. 2. Again, width W2 being greater than width W1 more weight may be disposed towards the bottom 22 of base 12 therefore imparting the aforementioned stability thereto.

Base 12 may further include a central aperture 44 defined through substantially the center of flat surface 34 and a bearing and/or flange 46 disposed therein for rotational interaction with foot support assembly 18 as described further herein. Central aperture 44 may pass through base 12 from front 24 to back 26 and may further define a rotational axis A, as best seen in FIG. 3.

Base 12 may further include a handle 48 defining a handle opening 50, which may be disposed at the top 20 thereof, or in any other suitable place as dictated by the desired implementation. Handle 48 may be formed as a single part of base 12 or may be formed separately and fixed thereto to define handle opening 50 to allow a user to carry and/or transport plank trainer 10 as desired.

With continued reference to FIGS. 1 and 2 but particular reference to FIG. 2, first and second risers 14 and 16 will now be described. First riser 14 may be generally rectangular and sized to fit into bottom 22 of base 12 as described herein. First riser 14 may have a top 52 spaced vertically apart from a bottom 54 and defining the height H2 of first riser 14 there between. First riser 14 may further have a front 56 spaced transversely apart from the back 58 and a first side 60 corresponding to first side 28 of base 12 and a second side 62 corresponding to second side 30 of base 12. First riser 14 may have one or more ribs 64, or projections, extending upward from the top 52 thereof to interact or otherwise engage with notches 23 defined in bottom 22 of base 12 (or with notches 146 (best seen in FIG. 5B) defined in the bottoms 54, 68 of first and/or second risers 14 and/or 16, discussed below) to secure first riser 14 to bottom 22 of base 12 (and/or to the other riser).

Second riser 16 may be substantially similar or identical to first riser 14 and may include a top 66 space vertically apart from a bottom 68 defining the height H3 of second riser 16 there between. Second riser 16 may further include a front 70 spaced apart from a back 72 and a first side 74 spaced apart from a second side 76, again corresponding to first and second sides 28 and 30 of base 12. As with first riser 14, second riser 16 may further include one or more ribs 78, or projections, operable to engage notches 23 in base 12 or notches 146 defined in the bottom 54 of first riser 14.

As shown first and second risers 14 and 16 may be substantially identical and may have equal heights wherein height H2 is the same as height H3, this may allow different height configurations for plank trainer 10 wherein the overall height (H1+H2+H3) of plank trainer 10 may be adjusted to change the operational angles for plank exercises performed utilizing plank trainer 10 as discussed further herein. According to another aspect height H2 and H3 of first and second riser 14 and 16 respectively may differ to allow for differing configurations and/or overall heights of plank trainer 10 as discussed further below.

With reference to FIGS. 1-4, foot support assembly 18 may generally be circular in shape and may connect to flat surface 34 of base 12 as discussed further herein. Foot support assembly 18 may therefore have a top 80 corresponding to top 20 of base 12, a bottom 82, a front 84 spaced apart from a back 86 and a first side 88 spaced apart from a second side 90. Generally speaking, top 80, bottom 82, front 84, back 86, first side 88, and second side 90 may generally correspond to top 20, bottom 22, front 24, back 26, first side 28, and second side 30 of base 12 as illustrated herein.

Foot support assembly 18 may further include a base plate 92, which may generally be a circular disc operable to interact with flat surface 34 of base 12 as described herein. Base plate 92 may have an outer wall 94, which may extend around a portion of the circumference of base plate 92. Outer wall 94 may transition into inner wall 96, which may further define a pair of vertical side walls 98 and a bottom wall 100 to form a U-shaped foot well 102, as shown. The outer wall 94 may extend outward towards the front 84 of foot support assembly 18 and may define a width W3 thereof (as seen best in FIG. 3).

As described further herein, the U-shaped foot well 102 may be configured to allow insertion of a user's foot and/or feet into the foot well 102 to perform planking exercises therewith.

Foot support assembly 18 may further include a first adjustment block 104 and a second adjustment block 106, which may further define at least a portion of the U-shaped foot well 102 and may be adjusted to narrow the width W4 of foot well 102 (as seen best in FIG. 5A and described further below). In particular, first and second adjustment blocks 104 and 106 may further define foot engaging surfaces 105 and 107, respectively (discussed below), that may further form part of vertical side walls 98 of U-shaped foot well 102.

First and second adjustment blocks 104 and 106 may be operably connected to foot support assembly 18 through the use of a first adjustment screw 108 and first adjustment apertures 110 for first adjustment block 104 and second adjustment screw 112 and second adjustment apertures 114 for second adjustment block 106. Specifically, foot support assembly 18 may further include a first base block 116 having a first screw receiver 120 defined therein and a second base block 118 having a second screw receiver 122 defined therein. First and second base blocks 116 and 118 may further include a first block slide rail 124 and second block slide rail 126 respectively. As discussed further below, first adjustment block 104 may then mount to first base block 116 and first block slide rail 124 via the interaction of first adjustment screw 108 and first screw received 120, while second adjustment block 106 may be adjustably secured to second base block 118 and second block slide rail 126 via the interaction of second adjustment screw 112 and second screw receiver 122.

Figure 8A:
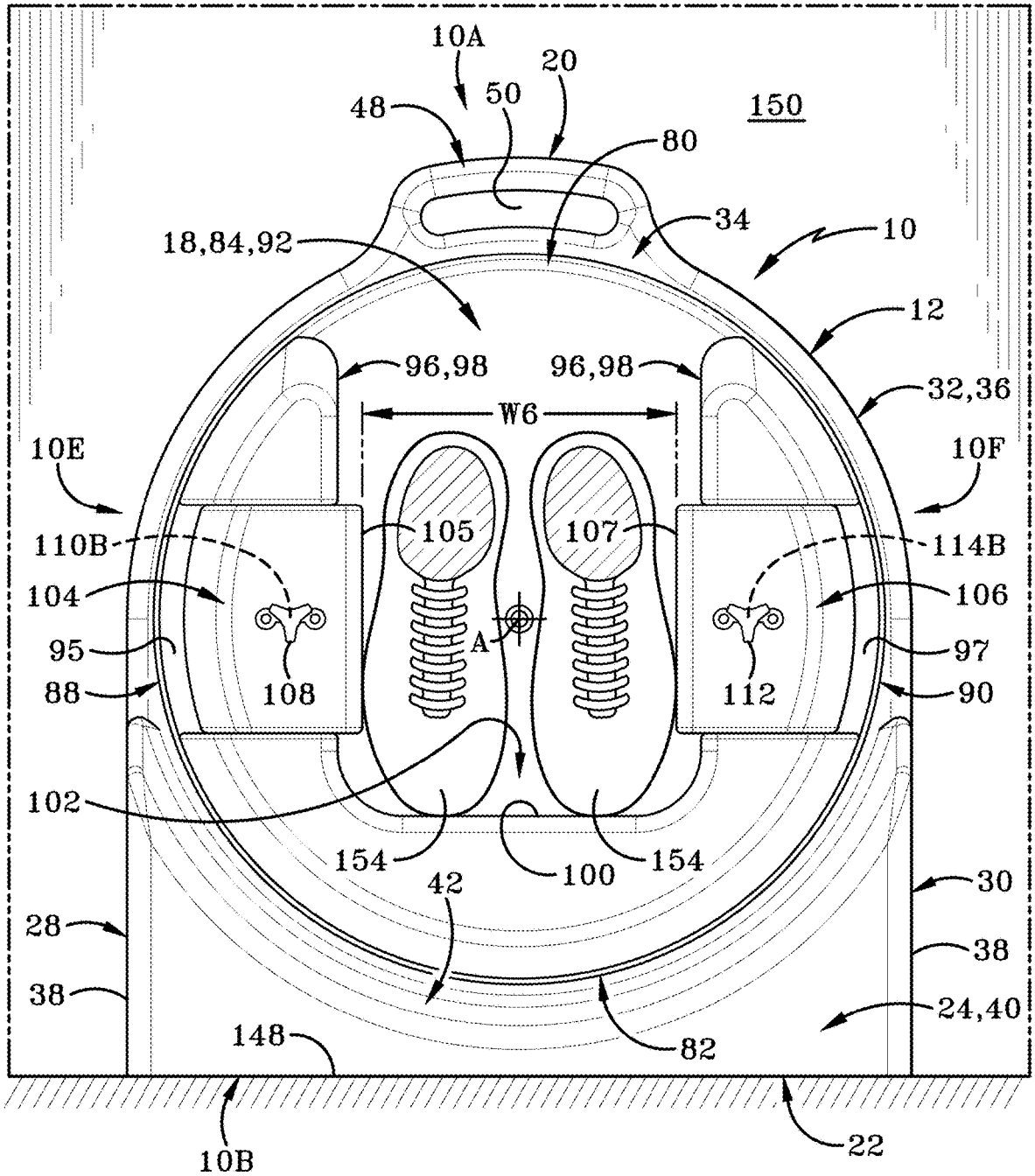
FIG. 8A is a front elevation operational view of the first embodiment of the planking training device shown in FIG. 6A.
Figure 8B:
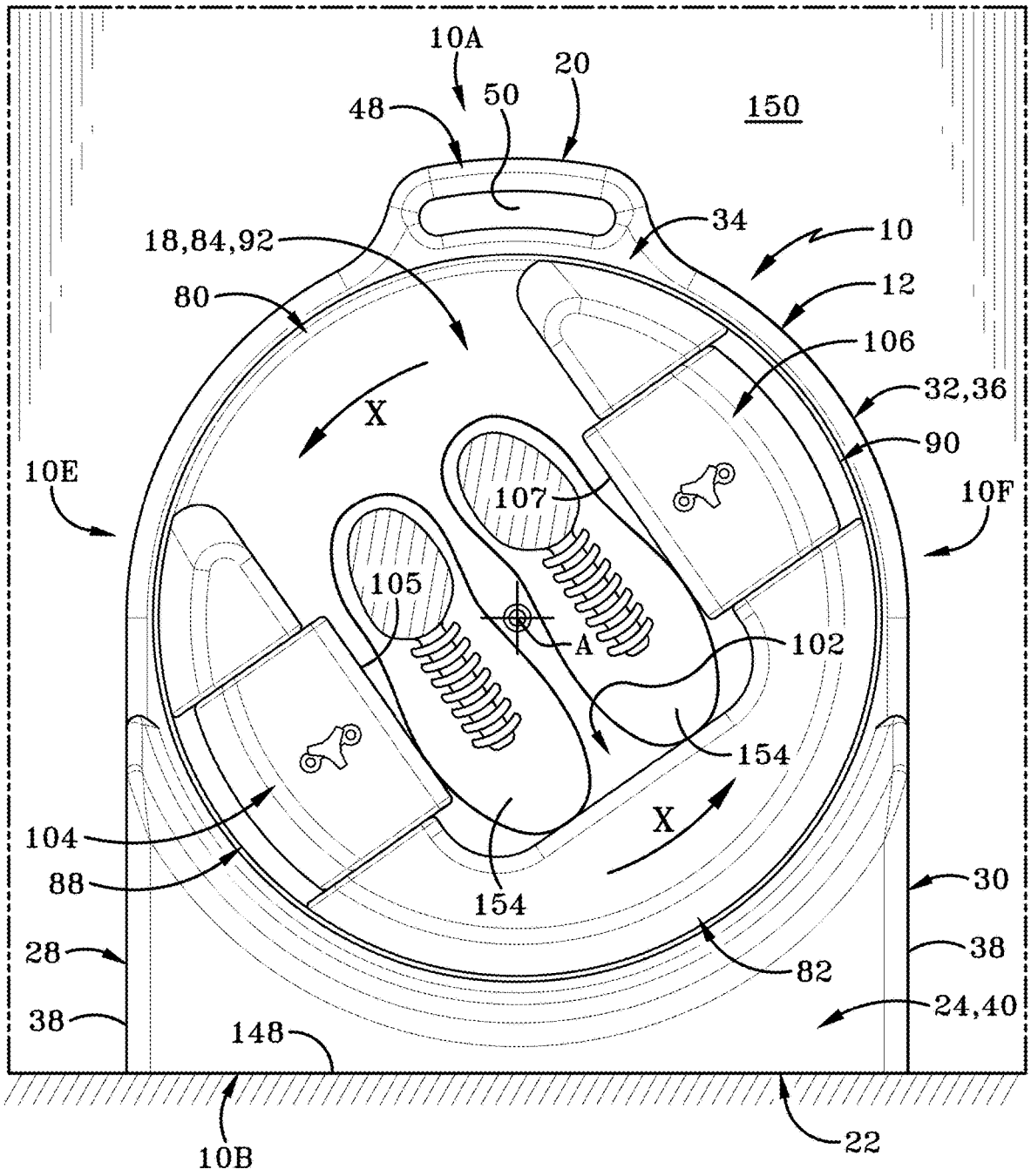
FIG. 8B is a front elevation operational view of the first embodiment of the planking training device shown in FIG. 6B.

With reference to FIG. 3, foot support assembly 18 may further define a central aperture 128 through base plate 92, which may align with central aperture 44 of base 12 to allow rotating connection between foot support assembly 18, base plate 92 and flat surface 34 of base 12. Specifically, foot support assembly 18 may be mounted to flat surface 34 of base 12 utilizing a screw 130, washer 132, and nut 134 which may be inserted through central apertures 128 and 44 of foot support assembly 18 and base 12 to allow rotational connection via bearing 46 about rotational axis A as described further herein. It should be understood that central aperture 44 of base 12, central aperture 128 of base plate 92, bearing 46 of base plate 92, screw 130, washer 132 and nut 134 of foot support assembly 18 together define a rotational assembly 180. Rotational assembly 180 is configured to connect base 12 and foot support assembly 18 to one another. Further, rotational assembly 180 is configured to allow for foot support assembly 18 to rotatably engage base 12 along axis "A" (FIG. 3) and rotation in the direction of arrows "X" (FIG. 8B).

Figure 5A:
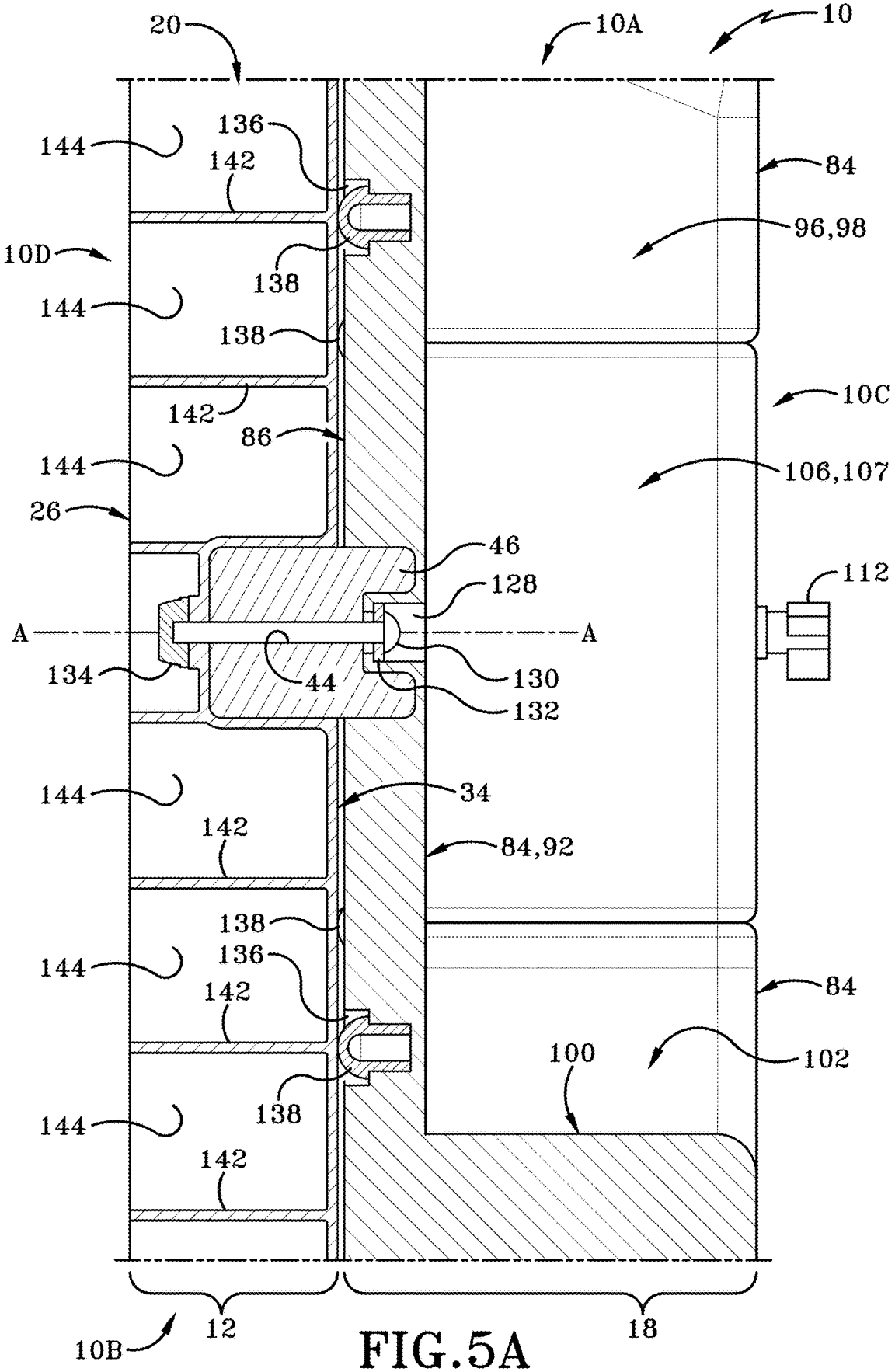
FIG. 5A is a partial cross sectional view looking in the direction of line 5A-5A shown in FIG. 6A according to an aspect of the present disclosure.

With reference to FIG. 5A, foot support assembly 18 may further include one or more recesses 136 defined in the back 86 thereof with a low-friction foot 138 extending from back 86 into recess 136. Low-friction foot 138 may further include an anti-friction coating or similar material to provide reduced friction and/or reduced interaction between the back 86 of foot support assembly 18 and the flat surface 34 of base 12. This may further promote free rotation of foot support assembly 18 as described further herein. Low-friction foot 138 may be any suitable antifriction material, including but not limited to high-density polyethylene or other similar materials having a low coefficient of friction to allow slideable engagement between the low-friction foot 138 and flat surface 34 of base 12.

Figure 5B:
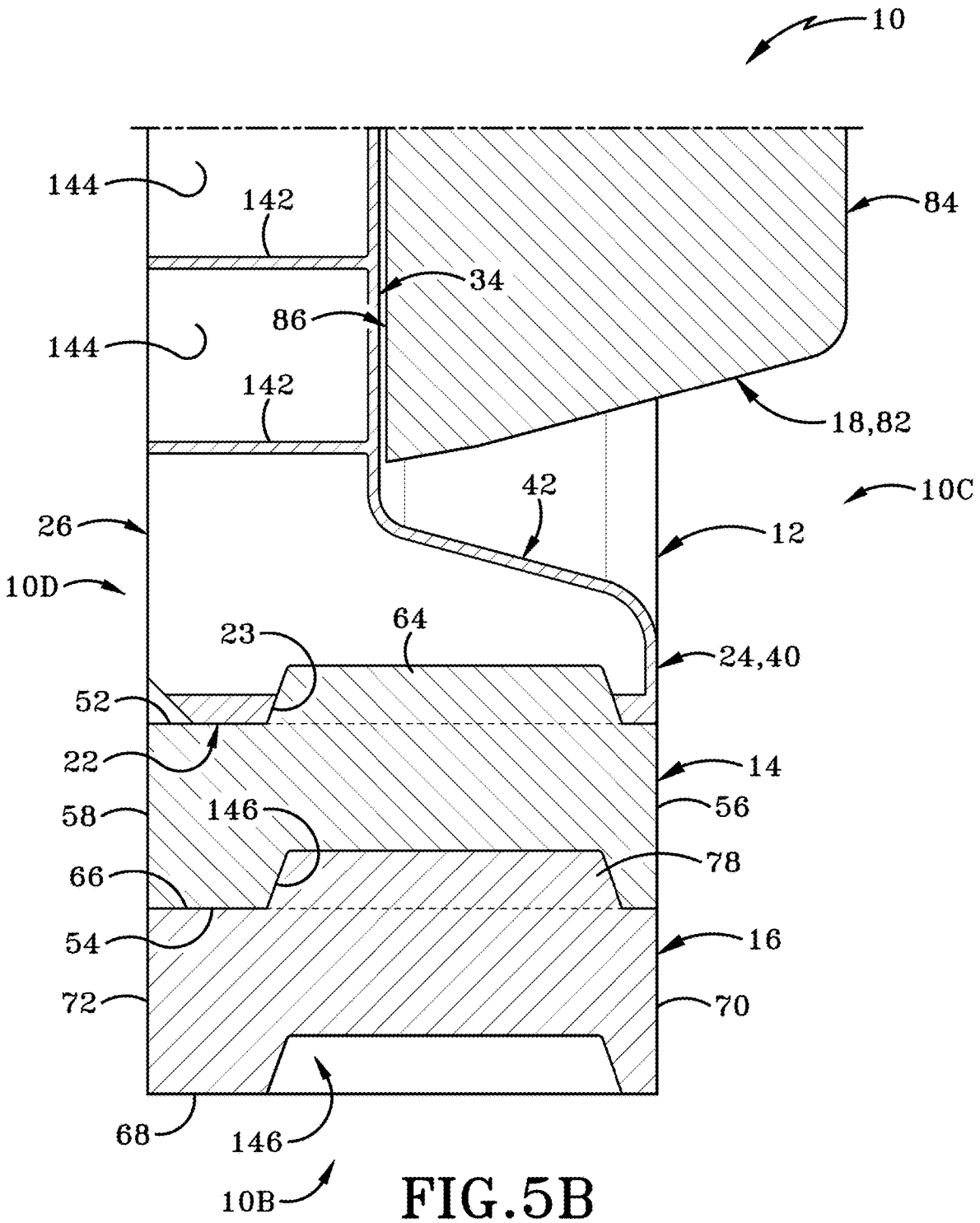
FIG. 5B is a partial cross sectional view looking in the direction of line 5B-5B from FIG. 6A according to an aspect of the present disclosure.

With reference to FIGS. 5A and 5B, base 12 may be formed to have one or more support ribs 142 and cavities 144 in the back thereof, to reduce the weight of plank trainer 10 while allowing from structural rigidity thereof. Similarly, base 12, particularly bottom 22 thereof, may further define on or more notches 23 corresponding to the ribs 64 and/or 78 of first and/or second risers 14 and 16 as discussed above. Similarly, notches 146 may be formed in the bottom 54 of first riser 14 and/or the bottom 68 of second riser 16, as dictated by the desired implementation. It is contemplated that notches 23, 146 may be formed in the bottoms 22, 54, and 68 of base 12, first riser 14 and second riser 16 respectively to allow stackable and adjustable configurations thereof as desired and as discussed further below.

Figure 6A:
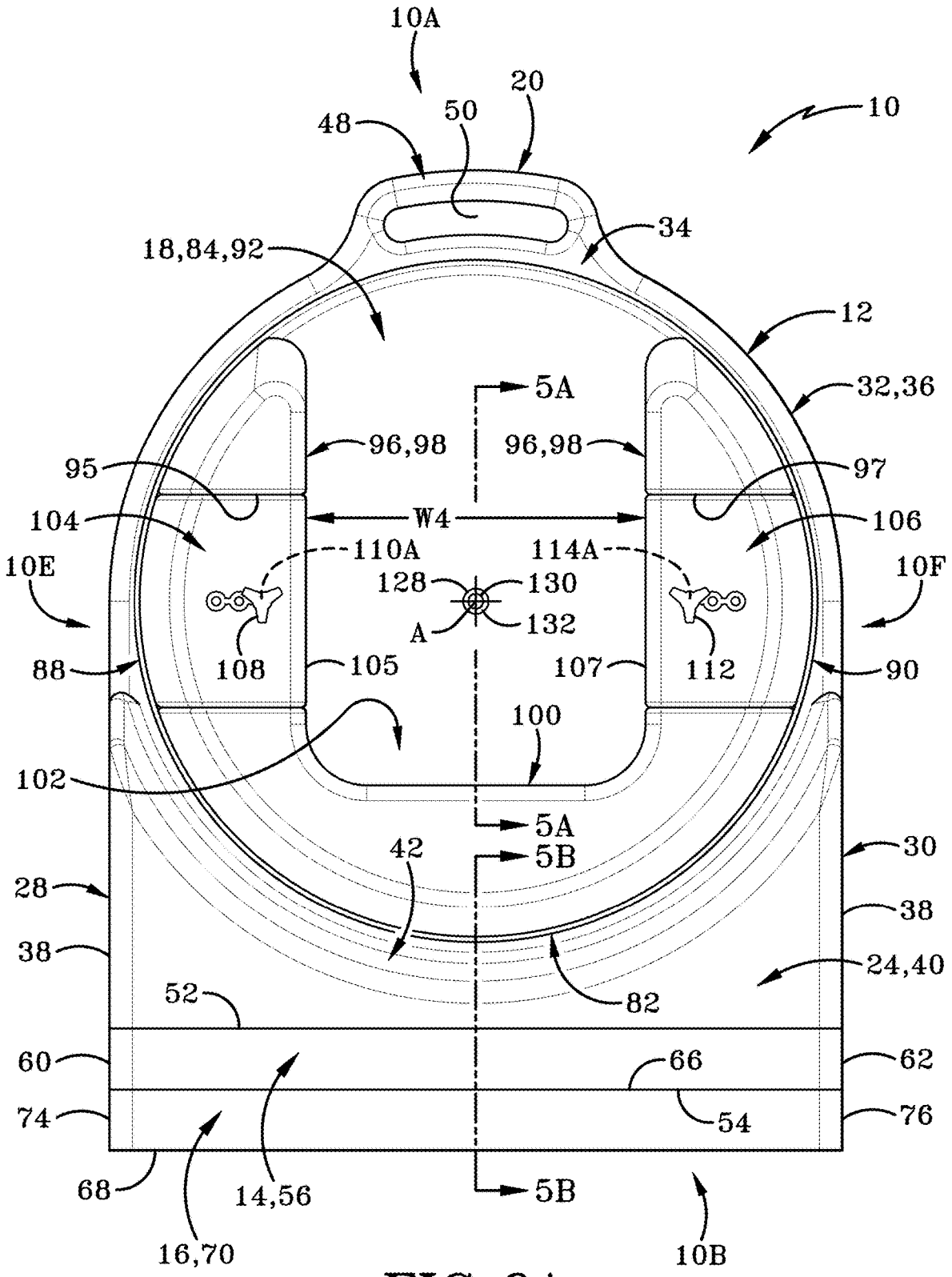
FIG. 6A is a front elevation view of the first embodiment of the planking training device in shown in FIG. 1 in a first configuration.
Figure 6B:
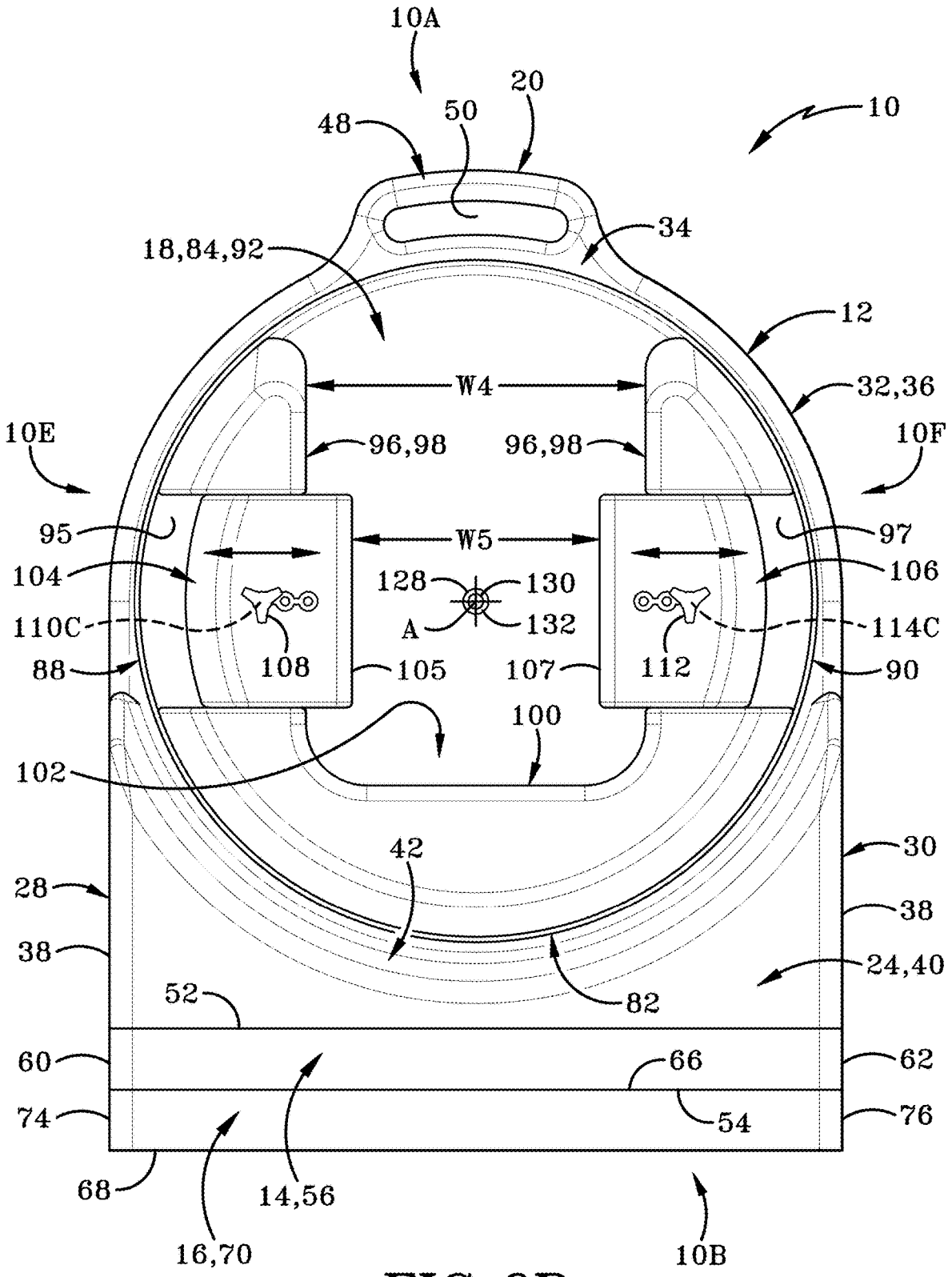
FIG. 6B is a front elevation view of the first embodiment of the planking training device shown in FIG. 1 in a second configuration.
Figure 8C:
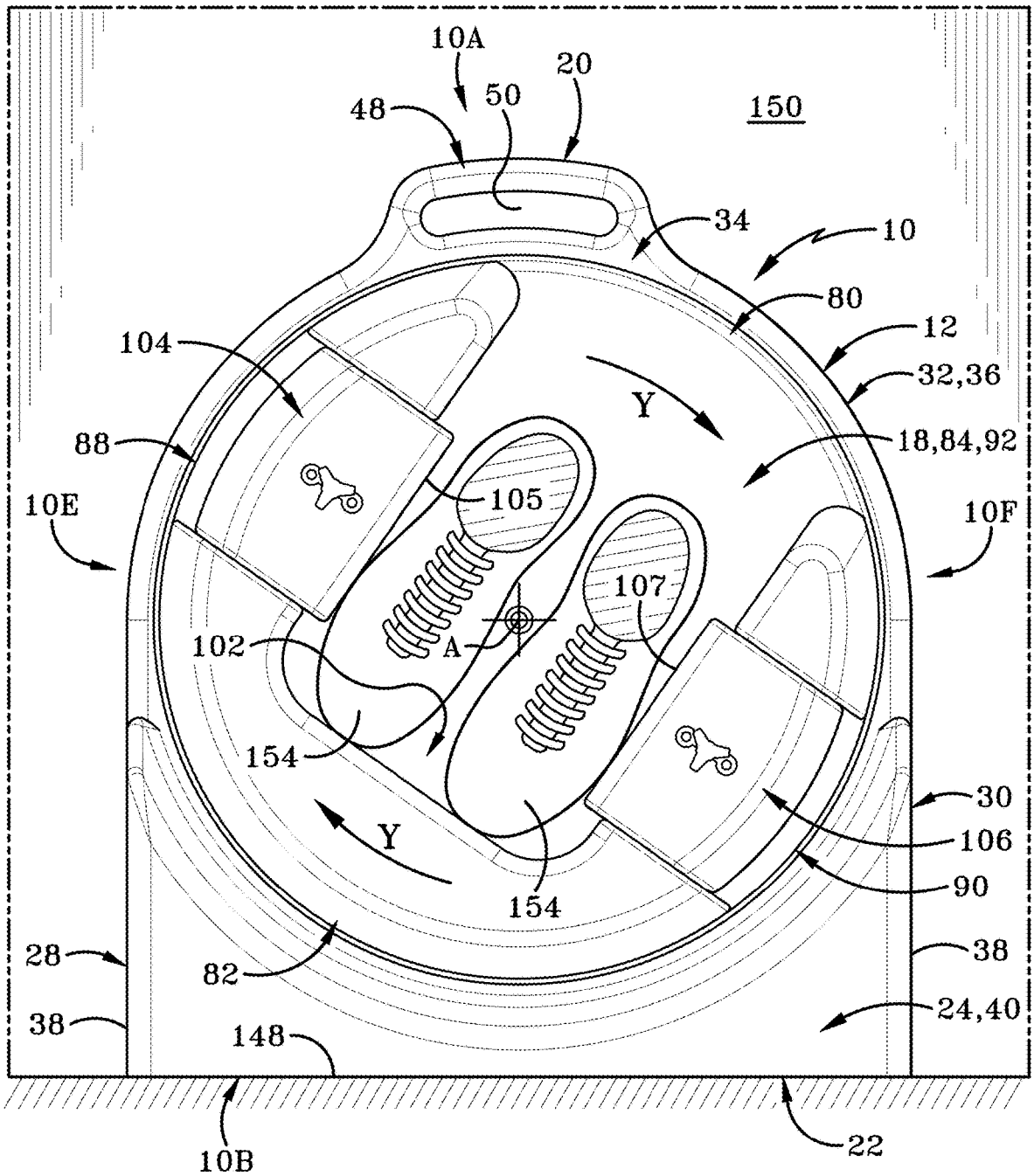
FIG. 8C is a front elevation operational view of the first embodiment of the planking training device shown in FIGS. 6A and 6B in a third configuration.

With reference to FIGS. 6A and 6B the adjustment of first and second adjustment blocks 104 and 106 will now be described in further detail. Specifically, U-shaped foot well 102 defined by the vertical sidewalls 98 and bottom wall 100 of inner wall 96 may have a fourth width shown as W4 in FIG. 6A. This width may be generally sized to fit a user's feet, including shoes, therein (as shown in FIGS. 8A-8C). Adjustment blocks 104 and 106 may be moved in or out to various positions to narrow the foot well 102 to more securely hold a user's feet while plank exercises are being performed.

Figure 4:
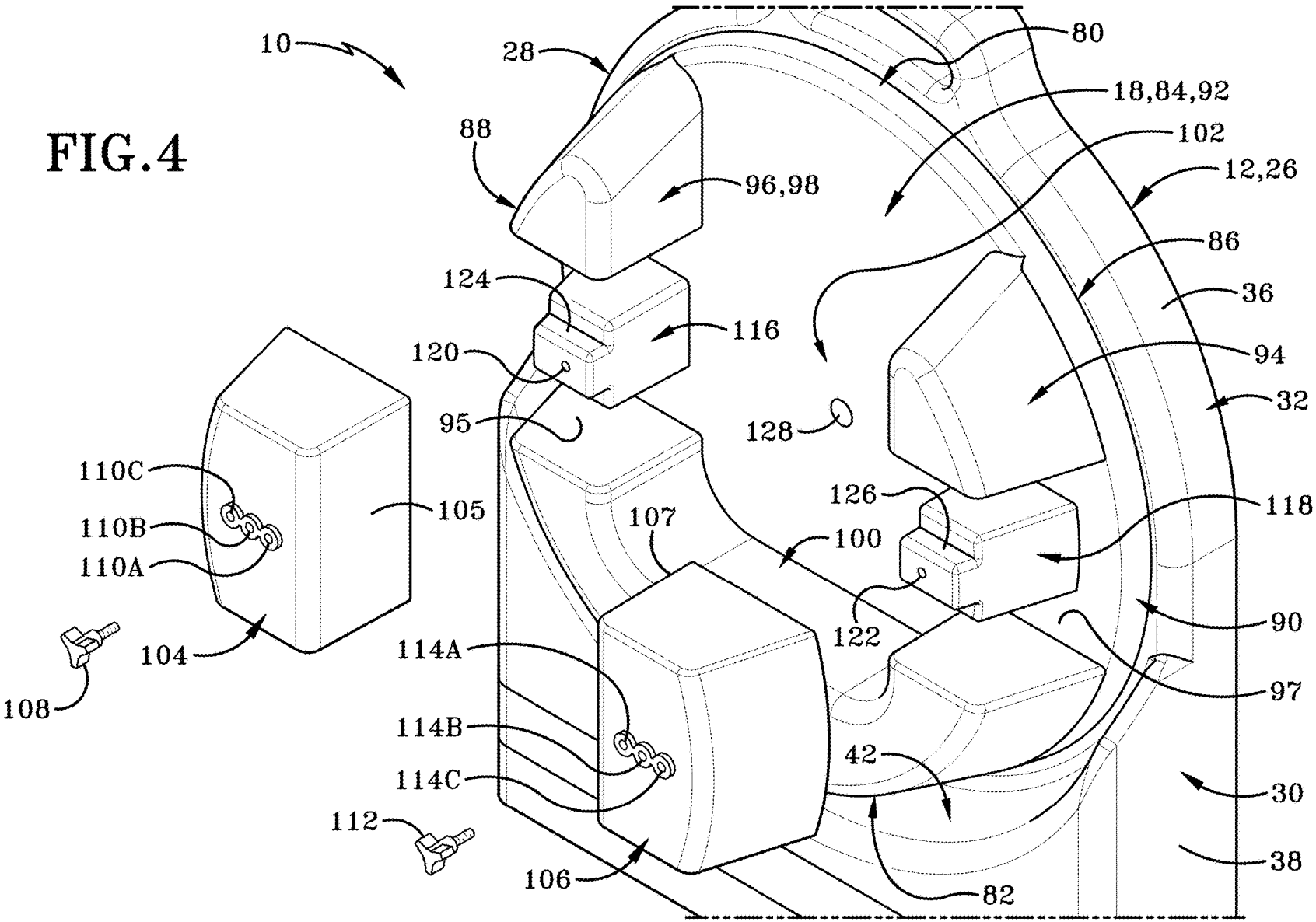
FIG. 4 is a front, right, top perspective exploded view of another portion of the first embodiment of the planking device shown in FIG. 1.

Specifically, as best seen in FIG. 4, plank trainer 10 is shown with three positions for adjustment blocks allowing three widths of foot well 102 as discussed further below. These three positions may be defined by first and second adjustment apertures 110 and 112 and are shown at reference letters A, B, and C. Specifically, 110A may represent a first position for first adjustment block 104, 110B representing a second position for first adjustment block 104, and 110C representing a third position for first adjustment block 104. Similarly, 114A, 114B, and 114C may represent first, second and third positions of second adjustment block 106 respectively. Then, as mentioned above adjustment blocks 104 and 106 may be moved to the second or third position by removing the first and second adjustment screws 108 and 112 from the adjustment apertures 110 and 114, sliding first and second adjustment blocks 104 and 106 along the first and second block slide rails 124 and 126 to a new position wherein the desired adjustment aperture 110 and 114 aligns with first and second screw receivers 120 and 122 before replacing adjustment screws 108 and 112. Plank trainer 10 includes a first cavity 95 defined in base plate 92 near first block side rail 124. Plank trainer 10 includes a second cavity 97 defined in base plate 92 near second block side rail 126.

By allowing adjustment of both blocks 104 and 106 independently, multiple positions and/or configurations may be realized. Although shown herein with three positions for each block 104 and 106, it will be understood that only one block may be adjusted and therefore nine different configurations of the two adjustment blocks 104 and 106 may be realized. Although only three positions are shown in the figures herein it will be understood that all nine configurations may be utilized during plank exercises as desired and as discussed herein.

Specifically, as mentioned above, a first position may result in width W4 in FIG. 6A while a second position may result in width W5 shown in FIG. 6B. An intermediate or third position between the first and third positions may be realized utilizing second adjustment apertures 110B and 114B and may result in width W6 seen in FIGS. 8A-8C.

The adjustment of blocks 104 and 106 may allow for users having different sized feet and/or shoes to be accommodated in foot well 102 to securely hold a user's feet therein during planking exercises. Additionally, the adjustment of blocks 104 and 106 may adjust the distance (shown as distance D in FIGS. 8A-8C) between the user's feet to provide different exercise benefits to the user performing planking exercises as discussed further herein.

Figure 7:
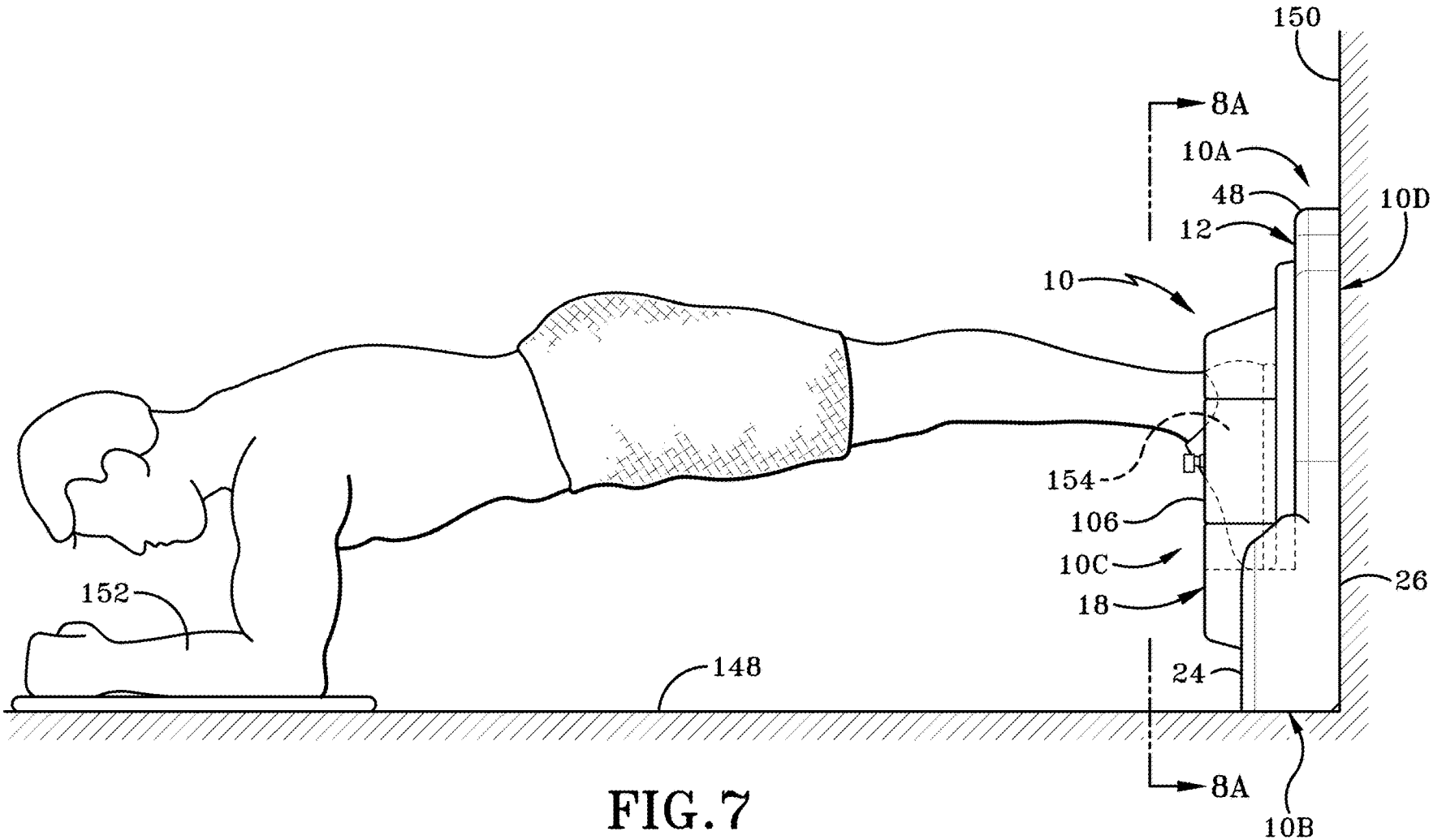
FIG. 7 is a right elevation operational view of the first embodiment of the planking training device according to one aspect of the present disclosure.

With reference to FIGS. 7-8C, the operation and use of plank trainer 10 will now be discussed.

As provided herein a plank or planking exercise is an exercise wherein a user maintains a relatively flat position while laying prone to a ground surface 148 either on their hands or forearms. As seen in FIG. 7 this position known as the planking position, may be obtained by resting a user's feet 154 on the ground surface 148 while supporting their upper body with forearms 152. Variations on planking exercises may involve different positions for the forearms 152 and/or raising the feet 154 above the ground surface 148. Additionally, more advanced variations on planking exercises, may involve rotating a portion of the user's body to place physical stress on the user's muscles and force them to become stronger to compensate.

Accordingly, the use of plank trainer 10 is contemplated to raise a user's feet 154 off of the ground surface 148 and to allow rotational movements of the user's feet 154 and legs to incorporate additional moves into planking exercises to increase the difficulty and therefore benefits of performing such exercises.

Specifically, plank trainer 10 may be placed at the intersection of ground surface 148 and wall 150 with the bottom 22 of base and/or the bottoms 54 and/or 68 of the first and/or second risers against the ground surface 148 and the back 26 of base 12 against the wall 150, as seen in FIG. 7. As shown therein, neither of first or second risers 14 and 16 are shown, however their use will be discussed further below.

With plank trainer 10 properly placed against a wall 149 a user may place their feet 154 into the U-shaped foot well 102, again adjusting the first and second adjustment blocks to the desired width to properly secure their feet for the exercise that the user intends to perform. In this configuration the user's feet 154 may have their toes 158 against the bottom wall 100 with their heels 156 and bottoms of their feet 160 against the base plate 92 of foot support assembly 18. In this position the sides of the user's feet 162 may be secured against first and second adjustment blocks 104 and 106 and/or vertical side walls 98 as dictated by the specific exercise the user intends to perform. With user's feet 154 secured within foot well 102 a user may place his or her forearms 152 on the ground surface 148 (or on a mat as depicted in FIG. 7) and may assume the planking position.

With reference to FIG. 8A, exercises may be performed with user's feet elevated up off of the ground surface, which creates additional stress and shifts the weight forward causing different muscles to activate to compensate for the added stress. With reference to FIGS. 8B and 8C, the foot support assembly 18 may rotate about axis A in a counter clockwise direction (shown by arrows X in FIG. 8B) or a clockwise direction (shown by arrows Y in FIG. 8C) to rotate the user's legs and feet and place additional stress and emphasis on different muscles and muscle groups to compensate for the rotation. Similarly, a user may rotate their upper body to support themselves with one arm while simultaneously rotating their feet 154 within foot support assembly 18 as desired.

Adjustment blocks 104 and 106 may be adjusted to any suitable configuration as described herein to allow variation on additional exercises, including single foot exercises or the like.

Although shown with no risers installed in FIGS. 7-8C, first and/or second risers 14 and 16 may be utilized to raise the height of plank trainer 10 above the ground surface 148 as desired and/or as the user becomes more adept at performing planking exercises to increase the difficulty and benefits of the planking exercises. Specifically, where first and second risers 14 and 16, have similar heights plank trainer 10 may have a first configuration wherein base 12 sits directly on ground surface 148; a second configuration wherein one of first and/or second risers 14 and 16 are employed between the bottom 22 of base 12 and the ground surface 148; and a third configuration wherein both first and second risers 14 and 16 are employed between the bottom 22 or base 12 and the ground surface 148.

Where first and second risers 14 and 16 have different heights, additional adjustments may be realized. Specifically, the first position with base 12 against ground surface 148 may remain the same; a second position may employ first riser 14 with a different height than second riser 16; a third position my employ second riser 16 instead of first riser 14; or a fourth position may employ both first and second risers 14 and 16 as desired.

When risers 14 and/or 16 are utilized in performing planking exercises the ribs 64 and/or 78 thereof interacting with notches 23, 146 and may allow for secure engagement between risers 14 and 16 and base 12 to prevent slippage and/or unwanted movement thereof, which may reduce likelihood of injury while utilizing plank trainer 10.

Similarly, as discussed above the low-friction foot 138 on the back 86 of base plate 92 may allow for smooth rotational movement between base plate 92 of foot support assembly 18 and flat surface 34 of base 12 to prevent catching or friction between base plate 92 and flat surface 34 to allow free rotation, again with the goal of reducing potential injury utilizing plank trainer 10. This may further reduce the amount of wear and increase the longevity of plank trainer 10 accordingly.

Figure 9:
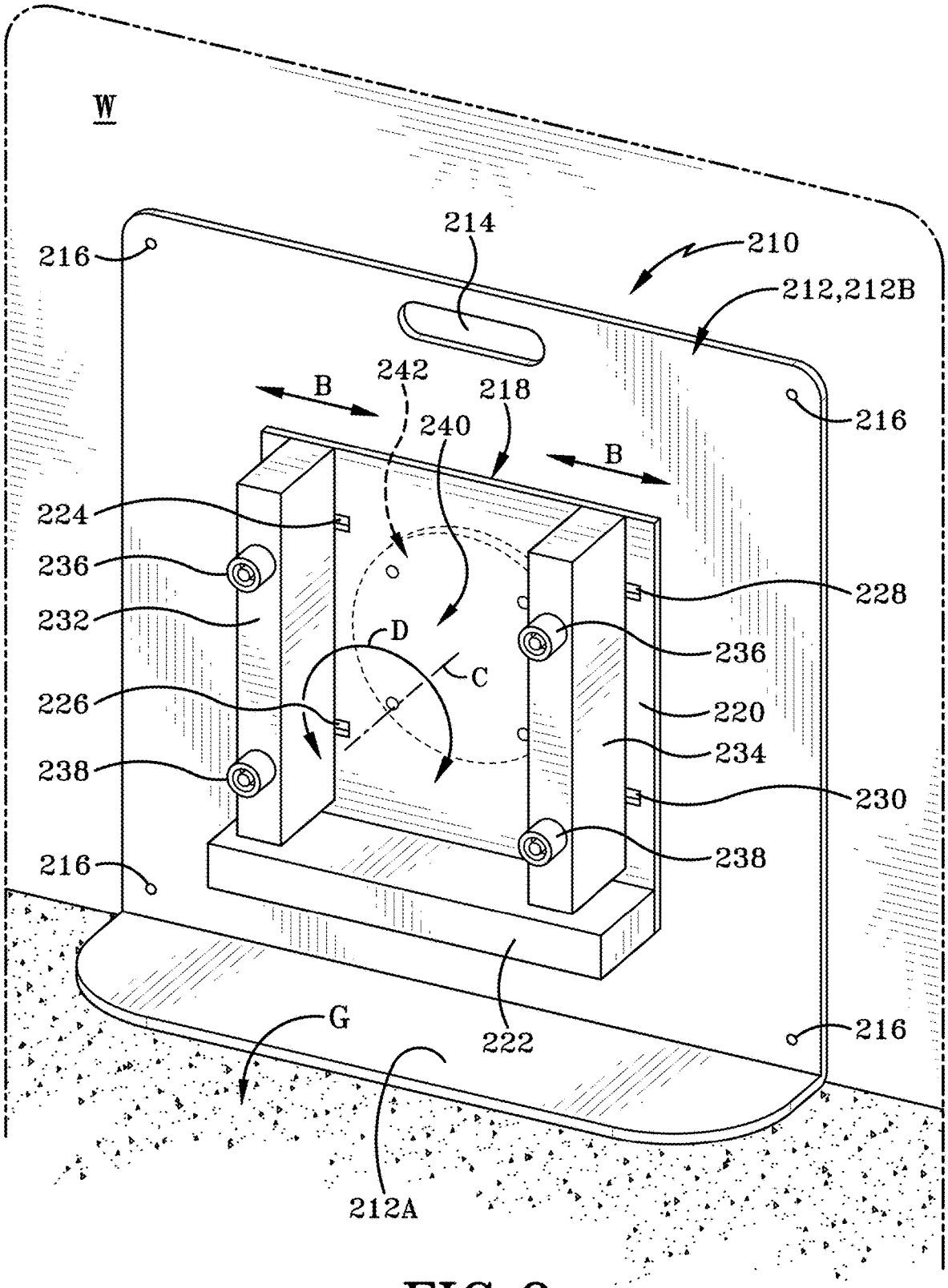
FIG. 9 is a front, right, top perspective view of second embodiment of a plank training device according with an aspect of the present disclosure.

Referring now to FIG. 9, there is shown a second embodiment of plank trainer in accordance with an aspect of the present disclosure, generally indicated at 210. Plank trainer 210 is substantially identical in function to plank trainer 10 but differs in some structural elements relative to plank trainer 10. The differences in the structural components of plank trainer 210 will be discussed hereafter.

Plank trainer 210 generally comprises of a base 212. As best seen in FIG. 9, base 212 comprises a bottom plate and 212A that defines a lower limit of plank trainer 210. Bottom plate 212A is adapted to engage a ground surface "G". Base 212 further comprises a back plate 212B operably engaged and substantially perpendicular to bottom plate 212A. Back plate 212B is adapted to engage a wall surface "W". Base 212 further defines a handle opening 214 extending through back plate 212A. Handle opening 214 is adapted to allow a user to lift and move the plank trainer 210.

Base 212 further defines at least one hole 216 extending through back plate 212B and adapted to receive a screw. The screw may be passed through the at least one hole 216 to secure back plate 212B and thereby the plank trainer 210 to a wall surface "W".

Plank trainer 210 also includes a foot support assembly 218, referred hereinafter as foot assembly, that operably engages with the base 212. As best seen in FIG. 9, foot assembly 218 is generally square in shape (when viewed from a front perspective view) and connects with back plate 212B of base 12 as discussed further herein.

Foot assembly 218 includes a base plate 220, generally square (when viewed from a front perspective view) in shape and operable to interact with back plate 212B of base 212 as described herein. Foot assembly 218 further includes a bottom or a foot support 222 operably engaged with base plate 220. Base plate 220 defines a first slot 224 extending through a portion of the base plate 220. First slot 224 is generally rectangular in shape. Base plate 220 further defines a second slot 226, a third slot 228 and a fourth slot 230 extending through a portion of the base plate and substantially identical to first slot 224 except for orientation.

Foot assembly 218 comprises a first adjustment block 232 and a second adjustment block 234 operably engaged with base plate 220. First adjustment block 232 and second adjustment block 234 are arranged on base plate 220 as mirror images of one another and oriented opposite to one another. Other than orientation, first adjustment block 232 and second adjustment block 234 are identical to one another. It will be understood that the following description of first adjustment block 232 will apply equally to second adjustment block 234.

First adjustment block 232 comprises a first locking device 236 extending through first adjustment block 232 and operably engaged with first slot 224. First adjustment block 232 further comprises a second locking devices 238 extending through first adjustment block 232 and operably engaged with second slot 226. First adjustment block 232 is slidably engageable with base plate 220 along first and second slots 224, 226 either together or independently in the direction of arrows "B". First adjustment block 232 is secured in a desired location along first and second slots 224, 226 via first and second locking devices 236, 238.

The space between the foot support 222, first adjustment block 232 and second adjustment block 234 define a foot well 240. As such, the foot well 240 may accommodate at least one foot of a user when operating the plank trainer 210, which is discussed in greater detail below.

Base 212 and foot assembly 218 rotationally engage one another along axis "C" via a rotational assembly 242. In operation, foot assembly 218 rotates about rotational assembly 242 in the direction of arrow "D".

Having now described plank trainer 210, a method of using plank trainer 210 will be described. It should be noted that the method of using plank trainer 210 is substantially identical to the method of using plank trainer 10, except for the following differences described hereafter.

Once the plank trainer 210 is placed on a ground surface "G" and against a wall surface "W", the user may place their feet atop foot support 222 and into foot well 240. The user may slide the first adjustment block 232 and second adjustment block 234 along the first, second, third and fourth slots 224, 226, 228, 230 to adjust the size and shape of the foot well 240 to be complementary to their needed shape and size. The user may then secure first and second adjustment blocks 232, 234 into the desires shape and size via first and second locking devices 236, 238 of each of the first and second adjustment blocks 232, 234.

The user then will begin their exercise and rotate their legs and feet as desired by rotating foot assembly 218 along axis "C" in the directions of arrow "D" via the rotational assembly 242.

Unless explicitly stated that a particular shape or configuration of a component is mandatory, any of the elements, components, or structures discussed herein may take the form of any shape. Thus, although the figures depict the various elements, components or structures of the present disclosure according to one or more exemplary embodiments, it is to be understood that any other geometric configuration of that element, component or structure is entirely possible.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding,"

"composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A plank training device, comprising:

a base having a first height;

a foot support assembly rotatably engaged with the base;

a foot well defined by the foot support assembly, wherein the foot well is singularly U-shaped and vertically-oriented in an initial position;

wherein the foot well is adapted to receive at least a portion of a human's feet; and wherein the foot support assembly is rotatable about an axis relative to the base.

2. The plank training device according to claim 1, further comprising:

a base plate of the foot support assembly adapted to support the portion of the human's feet;

at least one adjustable block adjustable relative to the base plate of the foot support assembly; and wherein the adjustment of the at least one adjustable block defines a size of the foot well.

3. The plank training device according to claim 2, wherein the at least one adjustable block further comprises:

an adjustment screw releasably engaging the at least one adjustable block to the foot support assembly between one or more positions relative to the foot support assembly.

4. The plank training device according to claim 3, further comprising:

a first set of adjustment apertures defined in the at least one adjustable block to receive the adjustment screw; and wherein the at least one adjustable block is moveable between a first position when the adjustment screw is secured to the foot support assembly through a first adjustment aperture of the first set of adjustment apertures and a second position when the adjustment screw is secured to the foot support assembly through a second adjustment aperture of the first set of adjustment apertures.

5. The plank training device according claim 3, further comprising:

a first adjustable block of the at least one adjustable block is adjustable relative to the base plate of the foot support assembly;

a second adjustable block of the at least one adjustable block is adjustable relative to the base plate of the foot support assembly; and wherein the adjustment of the first and second adjustable blocks defines the size of the foot well.

6. The plank training device according claim 2, wherein the at least one adjustable block is moveable relative to the base plate via at least one adjustment aperture and is secured thereto by at least one adjustment screw.

7. The plank training device according to claim 2, wherein the foot support assembly further comprises:

at least one slot extending through the base plate of the foot assembly;

at least one locking device extending through the at least one adjustable block and the at least one slot; and wherein the at least one locking device is configured to releasably secure the at least one adjustable block in a desired position relative to the base plate.

8. The plank training device according to claim 7, wherein the at least one adjustable block slidably engages the base plate of the foot assembly via the first and second slots of the at least one slot.

9. The plank training device according to claim 8, wherein the at least one adjustable block slidably engages the first and second slots together or individually.

10. The plank training device according to claim 2, further comprises:

at least one base block engaged with the at least one adjustable block; and at least one screw receiver defined by the at least one base block.

11. The plank training device according to claim 10, further comprises:

at least one block slide rail located on the at least one base block;

wherein the at least one adjustable block is mounted on the at least one base block; and wherein the at least one adjustable block is secured to the at least one base block via at least one adjustment screw.

12. The plank training device according to claim 10, wherein the at least one adjustable block is housed inside a cavity.

13. The plank training device according claim 1, further comprising:

at least one riser removably connected to a bottom of the base in which the at least one riser and the base are collectively defined at a second height that is greater than the first height.

14. The plank training device according claim 1, further comprising:

a first riser removably connected to a bottom of the base in which the first riser and the base are collectively defined at a second height that is greater than the first height; and a second riser removably connected to a bottom of the first riser in which the first riser, the second riser and the base are collectively defined at a third height that is greater than the first and second heights.

15. The plank training device according to claim 1, wherein the base further comprises:

a back plate adapted to engage a wall surface;

a bottom plate adapted to engage a floor surface; and wherein the back plate and the bottom plate are engaged with and substantially perpendicular to one another.

16. The plank training device according to claim 15, further comprising:

at least one hole defined in the back plate, wherein the at least one hole is adapted to receive a screw that secures the base to the wall surface at the at least one hole.

17. A method of performing planking exercises, the method comprising:

placing a base of a plank training device on a ground surface adjacent to a wall, the base having a first height;

inserting at least one of a user's feet into a foot well defined in a foot support assembly of the plank training device, wherein the foot well is singularly U-shaped and vertically-oriented in an initial position; and rotating the foot support assembly relative to the base of the plank training device while maintaining a plank position from the planking exercises.

18. The method of claim 17 further comprising:

adjusting at least one adjustment block of the foot support assembly to change a size of the foot well from a first width to a second width that is less than the first width.

19. The method of claim 18 further comprising:

adjusting a first adjustment block of the at least one adjustment block of the foot support assembly from a first position to a second position;

adjusting a second adjustment block of the at least one adjustment block of the foot support assembly from a third position to a fourth position; and defining the second width when the first adjustment block and the second adjustment block are respectively adjusted to the second position and the fourth position.

20. The method of claim 18 further comprising:

connecting at least one riser to the base; and defining a second height by the at least one riser and the base, collectively.

* * * * *